United States Patent [19]

Sanborn

[11] 4,296,562

[45] Oct. 27, 1981

[54] TRAVELING LIGHT DISPLAY

[76] Inventor: George A. Sanborn, 19210 NE. Clackamas St., Portland, Oreg. 97230

[21] Appl. No.: 103,848

[22] Filed: Dec. 14, 1979

Related U.S. Application Data

[63] Continuation of Ser. No. 887,753, Mar. 7, 1978, abandoned.

[51] Int. Cl.[3] ..... G09F 19/00

[52] U.S. Cl. ..... 40/438; 40/444; 40/472; 40/547; 40/579; 340/380; 340/763

[58] Field of Search ..... 40/447, 452, 442, 444, 40/472, 547, 550, 579, 438; 340/380, 752, 756, 763, 378.2, 378.4

[56] References Cited

U.S. PATENT DOCUMENTS

| | | | |
|---|---|---|---|
| 2,193,577 | 3/1940 | Walaity | 40/472 |
| 2,263,281 | 11/1941 | Von Tadden | 40/547 |
| 2,534,637 | 12/1950 | Sussin | 40/36 X |
| 3,184,872 | 5/1965 | Way | 40/547 X |
| 3,358,277 | 12/1967 | Selig | 40/452 X |
| 3,725,898 | 4/1973 | Canton | 340/324 |
| 3,786,500 | 1/1974 | Fiorletta et al. | 40/547 X |
| 3,789,521 | 2/1974 | Way et al. | 40/547 X |
| 3,815,986 | 6/1974 | Darbee | 340/380 X |
| 3,820,096 | 6/1974 | Himmelsbach et al. | 340/380 X |
| 3,836,911 | 9/1974 | Gibson et al. | 40/547 X |
| 3,959,729 | 5/1976 | Marchetti | 340/380 X |
| 3,962,702 | 8/1976 | Kriege | 340/380 |

FOREIGN PATENT DOCUMENTS

| | | | |
|---|---|---|---|
| 2001090 | 7/1970 | Fed. Rep. of Germany | 40/452 |

*Primary Examiner*—Gene Mancene
*Assistant Examiner*—G. Lee. Skillington
*Attorney, Agent, or Firm*—Oliver D. Olson

[57] ABSTRACT

A multiplicity of optic fibers are secured at their outer ends in a spaced-apart pattern at the front surface of a viewing panel and at their inner ends in a concentrated, spaced-apart pattern at the rear, input surface of a reader panel for registry with correspondingly spaced holes arranged in an elongated tape in patterns of letters, numbers and/or other desired indicia to be displayed for viewing in greatly enlarged form. A source of light is positioned on the side of the tape opposite the inner ends of the optic fibers for illuminating those fibers which register with holes in the tape. Drive mechanism is provided for moving the tape past the inner ends of the optic fibers for producing a traveling light display.

4 Claims, 8 Drawing Figures

TRAVELING LIGHT DISPLAY

This is a continuation of application Ser. No. 887,753, filed Mar. 7, 1978, now abandoned.

BACKGROUND OF THE INVENTION

This invention relates to illuminated signs, and more particularly to a traveling light type of advertising display in which illuminated indicia are moved across a viewing surface.

Prior illuminated signs of the type which displays successive indicia, such as letters spelling out word messages, have required a multiplicity of electric light bulbs mounted on a large display panel and connected in an electric circuit which includes a tray of mercury and a multiplicity of electrical contacts arranged for selective contact with the mercury by means of an interposed elongated tape provided with holes arranged in patterns representing indicia to be displayed by illumination of selected ones of the light bulbs as the contacts extend through the tape holes and make electrical contact with the mercury. Signs of this type are much too large for practical portability and use in small places, and they require excessive electric power for operation. They cannot be used on a mobile support, such as an airplane, because of errors introduced by loss of electrical contact with the mercury upon tipping of the airplane and because of complete failure of the sign upon loss of the mercury as a result of severe tilting of the airplane. Further, operation of the system results in the generation of mercury vapors which represent a hazard to health.

Prior illuminated signs of the type which may be transported manually and used in confined spaces, employ a multiplicity of optic fibers arranged in a spaced-apart pattern at their outer ends and in a concentrated, spaced-apart pattern at their inner ends, the latter registering with holes in a rotary disc or cylinder for illumination by a source of light on the side of the disc or cylinder opposite the inner ends of the optic fibers. This type of sign imposes a severe restriction on the number of indicia capable of being displayed in a repetitive cycle, thereby correspondingly limiting their practical applications. Typical of this type of illuminated sign are those described in U.S. Pat. Nos. 2,507,909; 3,184,872; and 3,836,911.

SUMMARY OF THE INVENTION

In its basic concept, this invention provides a traveling light display in which an elongated flexible tape of indeterminate length is provided with a multiplicity of holes arranged in patterns forming a multiplicity of longitudinally spaced indicia, the tape being driven past a light source whereby light passing through the holes in the tape results in the display of corresponding indicia which move across a viewing area in accordance with the movement of the tape relative to the light source.

It is by virtue of the foregoing basic concept that the principal objective of this invention is achieved; namely, to overcome the aforementioned disadvantages and limitations of prior illuminated traveling signs.

Another objective of this invention is the provision of a traveling light display of the class described in which the perforated tape is readily removable from the drive mechanism for replacement with other tapes.

Still another objective of this invention is the provision of a traveling light display of the class described which accommodates the changing of color of the light emitted at the viewing area.

A further objective of this invention is the provision of a traveling display of the class described which accommodates the stopping of the perforated tape automatically to provide a momentary stationary and, if desired, flashing display of some desired information.

Another objective of this invention is the provision of a traveling light display of the class described in which the light passing through each hole in the tape is conveyed to a viewing surface by an optic fiber.

Another objective of this invention is the provision of a traveling light display of the class described in which the light passing through each hole in the tape is utilized to activate a corresponding electric light bulb in an array of light bulbs on a viewing area.

A still further objective of this invention is the provision of a traveling light display of the class described which is of simplified and compact construction for economical manufacture, ready portability and versatility of use.

The foregoing and other objects and advantages of this invention will appear from the following detailed description, taken in connection with the accompanying drawings of preferred embodiments.

DESCRIPTION OF THE PREFERRED EMBODIMENTS

Figures 1, 2, 3, 4, 5:
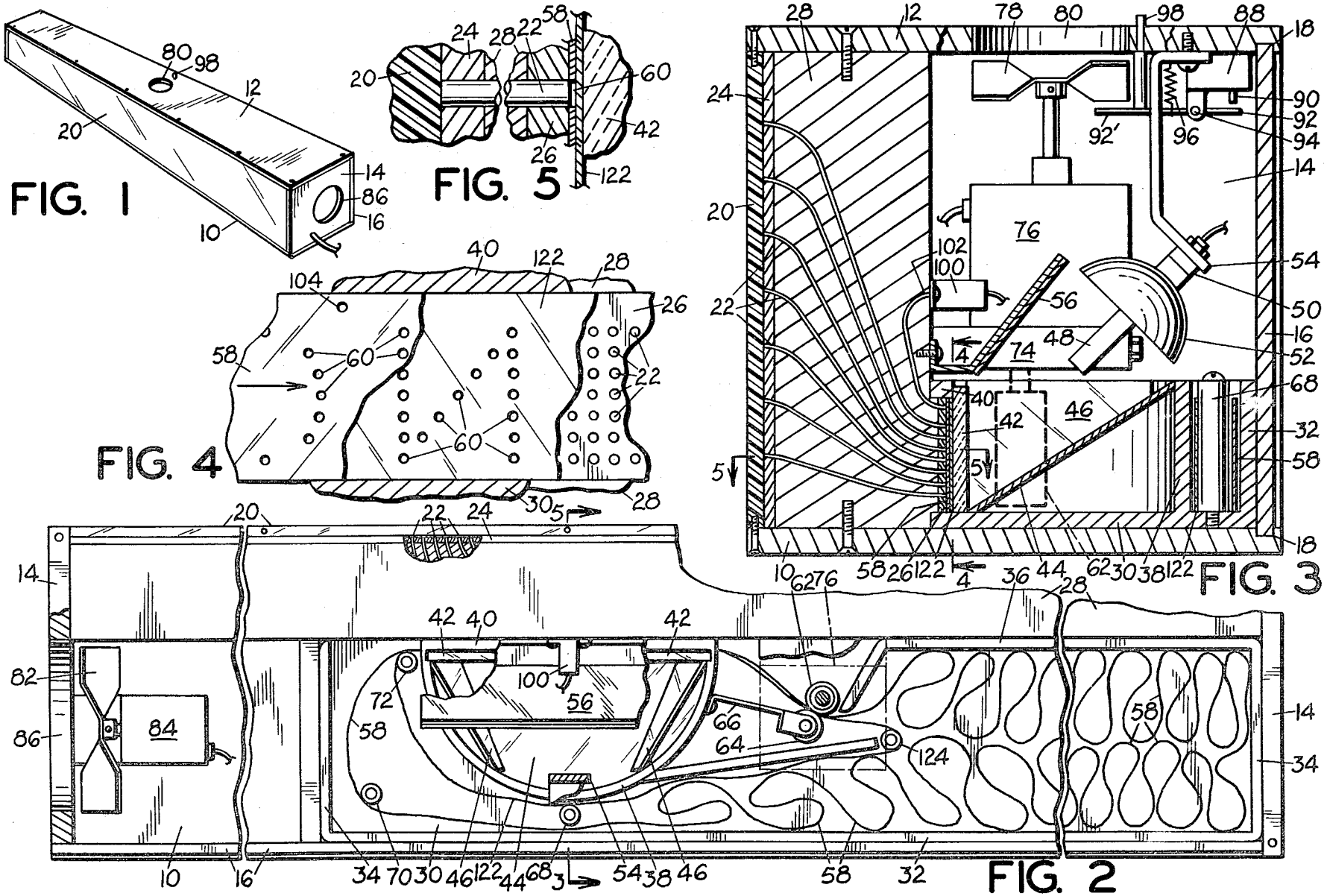
FIG. 1 is a front perspective view of a traveling light display embodying the features of this invention.
FIG. 2 is a fragmentary, foreshortened plan view of the display illustrated in FIG. 1, with the top removed to expose details of internal construction, parts being broken away to disclose further structural details.
FIG. 3 is a view in transverse section taken on the line 3—3 in FIG. 2.
FIG. 4 is a fragmentary sectional view taken on the line 4—4 in FIG. 3.
FIG. 5 is a foreshortened fragmentary sectional view taken on the line 5—5 in FIG. 3.

As illustrated in FIGS. 1-3 of the drawings, the traveling light display unit includes an elongated housing formed of a bottom wall 10, a top wall 12, end walls 14 and a rear wall 16. The rear wall preferably is mounted slidably in longitudinal grooves 18 provided in the bottom and top walls, for removal from one end of the housing, whereby conveniently to expose the interior of the housing.

The front wall 20 of the housing is formed of a transparent sheet of glass or clear plastic secured to the adjacent walls of the housing by such means as the screws illustrated. This front transparent wall serves to protect the outer, light output ends of optic fibers against contamination and other damage.

Mounted removably within the housing adjacent the front transparent wall is an assembly of a multiplicity of elongated optic fibers 2. As illustrated in FIG. 3, the outer, light output ends of the fibers are secured in holes provided in a predetermined spaced-apart pattern in an outer support panel 24 which provides a viewing surface. This panel extends the full length and width of the housing, behind the transparent front wall 20, and the pattern of openings covers substantially the entire area of the panel in order to maximize the size of letters, numbers or other indicia to be viewed through the transparent front wall.

The inner, light input ends of the optic fibers are similarly secured in a predetermined spaced-apart pattern but on a much smaller, concentrated area. As illustrated, this concentrated arrangement is provided by an inner support panel 26 which provides a reader surface provided with a multiplicity of openings each securing one of the optic fibers.

As an illustration, a traveling light display unit for use in a restaurant to advertise food specialties, has been provided in which the front support panel is about 95 cm. long by 16 cm. wide, and the inner, reader panel is about 17 cm. long by 3.5 cm. wide. The outer panel is provided with a pattern of forty-nine laterally spaced rows of holes, each row containing seven holes. The reader panel also is provided with the same number and pattern of holes, whereby to accommodate the anchoring between them of 343 optic fibers. It will be apparent, however, that these dimensions, patterns and number of optic fibers may be varied over wide limits, as desired.

In the preferred embodiment illustrated, the support panels and optic fibers are supported in substantially rigid, spaced-apart arrangement, by potting material 28. The material utilized for potting may be any suitable material which does not dissolve or otherwise adversely effect the optic fibers. A suitable potting material is a mortar of cement and sand, incorporating a black pigment or dye.

The potting material may function to support the entire lengths of the optic fibers, whereby the panels 24 and 26 may be eliminated. In such instance, the outer surface portion of the potting material forms a viewing member and the inner surface portion forms a reader member. In both instances, the inner ends of the optic fibers provide light passageways and the fibers function as couplers to produce spots of light at the viewing surface.

The integrated assembly of front and rear support panels, interconnected optic fibers and potting material, is mounted removably within the housing by such means as the screws illustrated.

As previously mentioned, the inner, light input ends of the optic fibers are arranged for cooperative association with an elongated opaque tape mounted for movement past the reader panel 26 and the inner ends of the optic fibers, the tape being provided with a multiplicity of openings arranged in patterns to provide a multiplicity of indicia. The holes are arranged to register with the inner ends of the optic fibers and thus allow the transmittal through the optic fibers of light provided by a source located on the side of the perforated tape opposite the optic fibers.

Referring to FIGS. 2 and 3 of the drawings, a laterally elongated tray is formed of a bottom wall 30, a rear wall 32, lateral end walls 34 and a partial front wall 36. The open front portion of the tray faces the reader panel 26 and is formed with an upstanding arcuate wall 38 which is open at its front end between the bottom wall 30 of the tray and an upper, transverse guide bar 40 which extends between the opposite ends of the arcuate wall at the upper end thereof. A pair of vertical grooves are formed in the arcuate wall adjacent the front end immediately behind the upper guide bar for the removable reception of a transparent glass plate 42.

Within the arcuate wall is mounted a base reflector 44 which slopes downward from the rear end of the wall forwardly to the bottom wall adjacent the bottom edge of the glass plate 42. A pair of side reflectors 46 also are mounted within the arcuate wall. These reflectors serve to concentrate a single light source uniformly across the glass plate and hence uniformly across the inner, light receiving ends of the optic fibers 22.

A single light source is provided in the housing. As illustrated, it is provided by a single high intensity electric lamp 48 mounted in a fixture 50 which includes a reflector 52. The fixture is supported at the bottom end of a bracket 54 which is secured at its upper end to the inner surface of the upper wall 12 of the housing, as by screws.

It is to be noted from FIG. 3 of the drawings that the lamp 48 and its fixture are mounted above the tray so as to allow removal of the latter from the housing, upon removal of the back wall 16. Another reflector 56 also is provided adjacent the forward, upper side of the electric lamp. It slopes downward in the forward direction toward and above the glass plate 42 and terminates above the tray so as not to interfere with removal of the tray. The reflector 56 is secured by a bracket to the potting material 28, as by means of screws.

The arrangement of reflectors 44, 46, 52 and 56 in association with the high intensity electric lamp 48 provides maximum light intensity substantially uniformly over the area of the glass plate 42 and hence the inner, light receiving ends of the optic fibers 22 supported by the reader panel 26.

The vertical spacing between the bottom wall 30 of the tray and the upper guide bar 40 provides a lateral channel into which the reader panel 26 is removably received. A space is provided between the reader panel 26 and the glass plate 42 for the free reception of at least one elongated tape. In the embodiment illustrated, the space accommodates the reception of two thicknesses of tape, as described hereinafter. The space thus serves as a guide for tape as it is moved laterally across the inner ends of the optic fibers 22.

In the embodiment illustrated, the preforated, elongated opaque tape mentioned hereinbefore as carrying the indicia to be enlarged and viewed from the front of the housing, is shown in FIG. 2 to be an elongated, continuous tape 58. It may be made of any desired flexible sheet material, such as paper or synthetic thermoplastic resin. A convenient form of the tape for use with the exemplified embodiment, wherein the inner support plate is 3.5 cm. wide, is 35 millimeter photographic film which has been processed to provide an opaque, preferably black surface. As illustrated in FIG. 4 of the drawing, the tape is perforated to provide a multiplicity of spaced-apart holes 60 arranged in a multiplicity of patterns to provide desired letters, numerals or other indicia. The holes also are arranged so as to register with the inner, light input ends of the optic fibers 22 as the tape moves laterally across the reader panel 26.

The perforated, message carrying tape 58 extends from the outfeed end of the guide space between the panel 26 and glass 42, and passes between the motor driven feed roll 62 and a resiliently mounted pinch roll 64. As illustrated, a resilient bracket 66 mounts the pinch roll at one end and is secured at its opposite end to the outer surface of the arcuate wall 38. As will be understood, the pinch roll is urged resiliently toward the feed roll to maintain the tape in positive contact with the feed roll.

As the tape moves toward the right in FIG. 2 from the feed roll, it moves into the storage compartment of the tray where it accumulates in a serpentine fashion. The tape extends toward the left in the tray and is fed through the space between a pair of spacer rolls 68 and 70 and the back and left end wall of the tray, and thence back around a guide roll 72 to the infeed end of the guide slot between the reader panel 26 and glass 42.

By the foregoing arrangement, a very long perforated tape 58 may be utilized to provide a very long message or other display. Being continuous, the long message repeats periodically as the tape is fed continuously past the inner, light receiving ends of the optic fibers. Alternatively, the tape need not be continuous, but rather mounted on wind and rewind reels, as are well known.

The feed roll is connected to the output driven shaft of a gear reduction unit 74 the input of which is connected to an output shaft of an electric motor 76. In the preferred embodiment illustrated, the output shaft of the electric motor extends from both ends, and the end opposite the gear reduction unit is fitted with a fan blade 78 by which atmospheric air may be drawn into the housing for cooling the interior. For this purpose the upper wall of the housing is provided with an opening 80 registering with the fan blade.

An additional fan is provided at the end of the housing opposite the tape tray. As illustrated in FIG. 2, a fan blade 82 is mounted on the output shaft of an electric motor 84 mounted within the housing, an opening 86 in the end wall registering with the fan blade.

Means preferably is provided for turning off the high intensity electric lamp 48 and the electric motor 76 in the event the motor speed is reduced, as by the jamming of tape 58, to such an extent that the fan 78 is unable to keep the tape cool enough to prevent it form burning or becoming otherwise damaged. In the embodiment illustrated, such means is provided by an electric switch 88 arranged in electrical series with the electric lamp 48 and with the drive motor 76 and operable by the velocity of air delivered from the fan 78 to maintain said circuits closed.

Thus, an electric microswitch 88 is mounted within the housing and the actuator plunger 90 projecting therefrom is arranged for contact by one end of an elongated lever 92 which is mounted pivotally intermediate its ends, by a pivot pin 94. The opposite end of the lever extends into the path of air movement from the fan blade 78, and is shaped as a rather wide vane 92' in order to intercept sufficient air velocity as to cause the lever to pivot counterclockwise (FIG. 3) to depress the microswitch actuator plunger and thus close the switch. A spring 96 interengages the lever and housing to urge the lever resiliently toward clockwise rotation and hence toward the open condition of the switch. Accordingly, when the velocity of air delivered to the vane end 92' of the lever is reduced below a predetermined magnitude, the spring urges the lever to the position illustrated in FIG. 3, thereby opening the microswitch and deenergizing the electric lamp 48 and motor 76.

A start plunger 98 secured to the lever 92 extends upwardly through an opening in the top wall 12 of the housing for engagement by a finger, and hence manual depression, to effect counterclockwise rotation of the lever and closing of the microswitch. The plunger thus serves to initiate activation of the electric lamp 48 and drive motor 76. Once the drive motor is in operation, air delivered to the vane end of the lever by the fan blade 78 maintains the microswitch plunger depressed and the switch closed.

Figure 6:
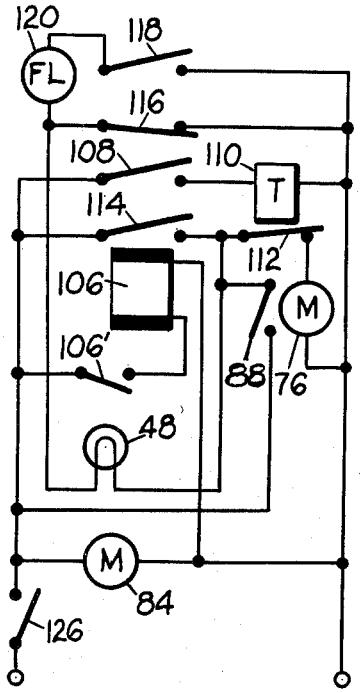
FIG. 6 is a schematic electrical diagram of an electric circuit for use in operating the display illustrated in FIGS. 2 and 3, the electric circuit being shown in inactive state.

Means also may be provided for stopping movement of the perforated tape 58 momentarily to display a word or other type of indicia in stationary form for viewing. In the embodiment illustrated, a photocell-operated relay unit 100 is mounted on the inner side of the potting material 28. The light source for the photocell component of the unit is provided by an optic fiber 102 having its outer end registering with the photocell and its inner end anchored in the reader panel 26 for reception of light from the same light source 48 as the optic fibers 22, when an opening 104 in the tape 58 registers with the optic fiber 102. The photocell operated relay 106 (FIG. 6) thus is energized by closure of the associated switch 106' in the electric circuit of the relay.

One normally open contact 108 of the relay (i.e. normally open when the relay is deenergized as in FIG. 6) is connected in series with an electric timer 110 for an electric switch 112, the switch being connected in series with the electric drive motor 76. A second, normally open contact 114 of the relay bypasses the microswitch 88. A third, normally closed contact 116 of the relay is connected in series with the electric light source 48 and the normally open contact 114 of the relay. A fourth, normally open contact 118 of the relay is connected in series with an electric flasher unit 120 across the normally closed contact 116 of the relay.

The opening 104 in the perforated tape 58 is positioned so that when a desired word or other indicia is displayed across the reader panel 26, the opening registers with the optic fiber 102. The photocell thus is energized, closing the switch 106' to complete the electric circuit of the relay 106 and transferring the associated contacts to the alternate positions from the positions illustrated.

Closure of the contact 108 energizes the timer 110 and opens the associated normally closed switch 112. The tape drive motor 76 thus is deenergized and the tape 58 stopped. The fan blade 78 also stops, and the lack of air velocity against the vane 92' allows the lever 92 to be rotated clockwise under the influence of the spring 96 to open the microswitch 88.

Closure of the normally open contact 114 of the photocell-operated relay by-passes the microswitch 88 and completes the electric circuit of the electric light source 48 through the flasher unit 120 and the closed contact 118 of the relay. The normally closed contact 116 of the rely having been opened, the circuit for the light source 48 is completed through the flasher unit 120, whereupon the stationary display viewed at the outer, viewing panel 24 is seen as intermittently flashing light.

Operation of the timer 110 ultimately returns its associated switch 112 to the closed position illustrated, whereupon the tape drive motor 76 is connected to the supply source through the closed relay contact 108. Activation of the tape drive motor simultaneously activates the fan blade 78 and returns the microswitch 88 to closed position. Activation of the tape drive motor also causes the perforated tape 58 to resume its movement past the reader panel 26. Accordingly, the opening 104 in the tape is withdrawn from registry with the optic fiber 102 associated with the photocell, whereupon the relay 106 is deenergized and the associated contacts returned to the positions illustrated.

Means also may be provided for displaying the traveling lights in any colors desired. The drawings illustrate two alternative means to achieve this purpose. One of said means is provided by the removable glass plate 42 which may be replaced by glass plates of various colors. The second means comprises a continuous, flexible, transparent film 122 which may be provided in a variety of colors. The film is positioned behind the perforated tape 58 in the guide slot provided between the reader panel 26 and glass plate 42, and it is fed between the drive roll and pinch roll, around an idler guide roll 124 and thence through the space between the spacer roll 68 and the arcuate wall 38 of the tray, back around the guide roll 72 behind the perforated tape. Thus, the colored film 122 is driven simultaneously with the perforated tape.

The colored tape may be provided in a plurality of connected segments of different colors, whereby to change the colors of the indicia being viewed at the outer panel 24.

In the operation of the traveling light display described hereinbefore, closure of the main control switch 126 results in energization of the fan motor 84. Manual depression of the start button 98 pivots the lever 92 counterclockwise (FIG. 3) to close the microswitch 88, resulting in activation of the electric light source 48 and the tape drive motor 76. Activation of the tape drive motor results in driving of the associated fan blade 78, whereupon the velocity of air drawn into the housing through opening 80 is applied to the vane end 92' of the lever, to maintain the microswitch closed.

Activation of the motor 76 drives the tape feed roll 62 and results in the perforated tape 58 being moved toward the right in FIG. 2 through the guide slot between the reader panel 26 and glass plate 42. As the perforations 60 in the tape register with the inner ends of the optic fibers 22, the resulting letters or other indicia are displayed to a viewer at the outer support panel 24, moving from right to left as viewed in FIG. 1, or left to right as viewed in FIG. 2.

As the perforated tape moves through the feed roll toward the right in FIG. 2, it is collected in serpentine manner in the right hand portion of the tray, while the preceding portion of the tape moves toward the left, around the rolls 68, 70 and 72, to enter the left side of the guide slot.

When a word, phrase or other desired indicia are to be displayed in stationary form across the viewing panel, the opening 104 in the tape 58 will have come into registry with the optic fiber 102, to activate the photocell unit 100 and its relay 106 to transfer the associated contacts from the positions illustrated, all as described hereinbefore.

It will be understood that if such a stationary display is not to be presented in flashing lights, the flasher unit 120 would be omitted, with corresponding simplification of the electric circuit.

The traveling light display unit described hereinbefore may be provided in a variety of sizes, all capable of portability. For example, the unit exemplified hereinbefore may be utilized in restaurants, as explained, and as window advertising signs for viewing by pedestrians. Still smaller units may be incorporated into table tops for the reading of menus and other messages, and still others may be substantially larger, yet portable, for the removable mounting on small airplanes for night viewing of advertising messages and other displays.

Figure 7:
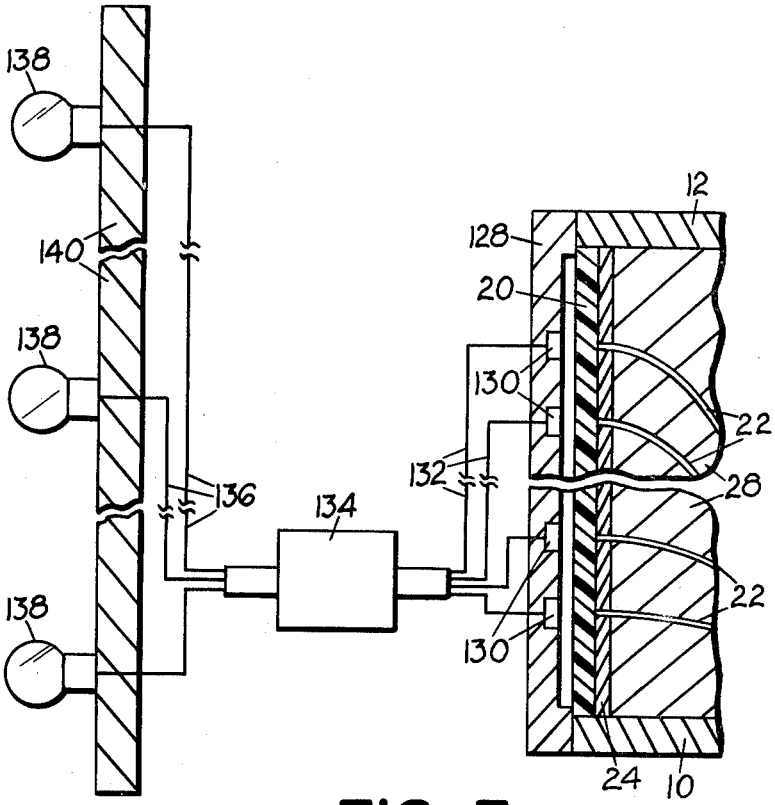
FIG. 7 is a fragmentary sectional view showing a second embodiment of the invention.
Figure 8:
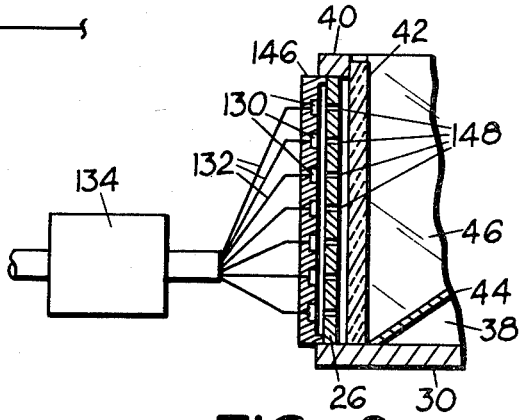
FIG. 8 is a fragmentary sectional view showing a third embodiment of the invention.

The display unit described hereinbefore also may be modified for use in controlling the multiplicity of electric light bulbs utilized in the very large size, permanently installed traveling light signs. Two such modifications are illustrated in FIGS. 7 and 8 of the drawings. Referring first to FIG. 7, a support panel 128 is secured over the front, transparent cover panel 20 illustrated in FIG. 3. The support panel mounts a multiplicity of phototransistors 130, or other type of light-responsive electric switch, each aligned with the light output end of a different one of the multiplicity of optic fibers 22.

Figure 9:
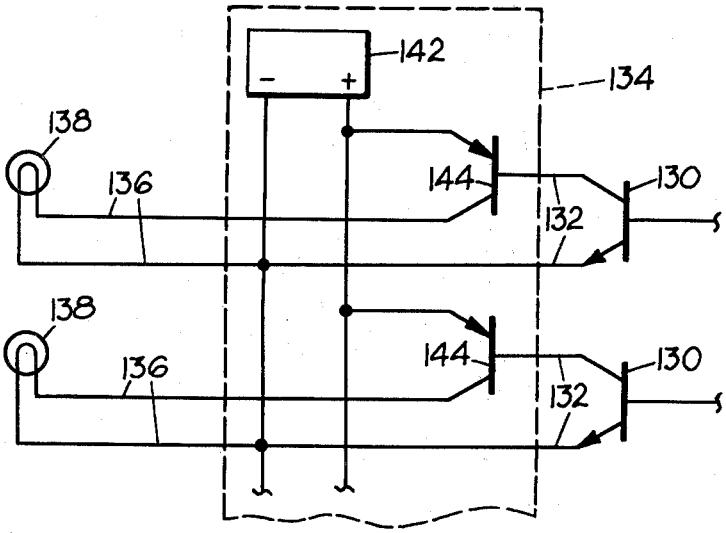
FIG. 9 is a schematic electrical diagram of an electric circuit for use in operating the second and third embodiments.

Electrical conductors 132 extend from the phototransistors to a control unit 134, and electrical conductors 136 lead from the control unit to the multiplicity of electric light bulbs 138 mounted on the large, permanent display panel 140. In FIG. 9, the control unit is shown by the broken line to include a source 142 of electric potential and a plurality of switching transistor 144 each associated with one of the phototransistors and one of the electric light bulbs.

In the operation of the system illustrated in FIG. 7, light conducted from the lamp 48 through selected ones of the optic fibers 22 activates the phototransistors 130 registering therewith. Activation of a phototransistor results in activation of the associated switching transistor 144, by completion of the electric circuit extending from the supply source 142 through the emitter-collector of the phototransistor and the base-emitter of the switching transistor. Activation of the switching transistor thereupon completes the electric circuit of the associated light bulb 138 from the supply source through the emitter-collector of the switching transistor. Thus, the assembly of phototransistors, switching transistors, power source and light bulbs functions as a coupler by which a spot of light appearing at the reader member 26 results in the display of a spot of light at the viewing panel 140.

In the modification illustration in FIG. 8, the assembly of optic fibers 22 illustrated in FIG. 3 is omitted and the multiplicity of phototransistors 130 are mounted in a support panel 146 secured in front of the reader panel 26. Each phototransistor is positioned in registry with a different one of the light passageway openings 148 through the reader panel 26. The operation of this embodiment is the same as described above in connection with FIGS. 7 and 9.

From the foregoing it will be appreciated that the present invention provides a traveling light display unit which is of simplified construction for economical manufacture, which is of compact size for convenient portability and versatile application to a wide variety of uses, which accommodates the changing of messages or other indicia with speed and facility, and which may be utilized as the control component of a large, permanent traveling light display utilizing a multiplicity of light bulbs.

It will be apparent to those skilled in the art that various changes may be made in the size, shape, type, number and arrangement of parts described hereinbefore without departing from the spirit of this invention.

Having now described my invention and the manner in which it may be used, I claim:

1. A traveling light display, comprising:

(a) an elongated reader member having therethrough a multiplicity of light passageways arranged in laterally and longitudinally spaced-apart relationship, (b) a source of light spaced from the reader member and arranged for directing light through said passageways, the source of light including an electric lamp in an electric circuit of a source of electric potential, (c) an elongated opaque tape having therethrough a multiplicity of holes spaced apart laterally and longitudinally for registration with passageways in the reader member and arranged in patterns forming a plurality of longitudinally spaced indicia, (d) drive means engaging the tape for moving the latter longitudinally past the reader member for producing at the light passageways said indicia patterns as spots of light moving across the reader member from one end to the other, the tape drive means including an electric drive motor in an electric circuit of a source of electric potential, an air fan driven by the tape drive motor, and an electric switch arranged in the electric circuits of the electric lamp and drive motor and operable by a predetermined velocity of air driven from the fan to complete said electric circuits and operable in the absence of said predetermined velocity of air to open said electric circuits, (e) an elongated viewing member, and (f) coupler means registering with each passageway in the reader member for causing a spot of light appearing at a passageway to result in the display of a spot of light at the viewing member moving across the latter from one end to the other.

2. The traveling light display of claim 1 including manually operable actuator means engageable with the electric switch for initially completing said electric circuits.

3. A traveling light display, comprising:

(a) an elongated reader member having therethrough a multiplicity of light passageways arranged in laterally and longitudinally spaced-apart relationship, (b) a source of light spaced from the reader member and arranged for directing light through said passageways, (c) an elongated opaque tape having therethrough a multiplicity of holes spaced apart laterally and longitudinally for registration with passageways in the reader member and arranged in patterns forming a plurality of longitudinally spaced indicia, (d) drive means engaging the tape for moving the latter longitudinally past the reader member for producing at the light passageways said indicia patterns as spots of light moving across the reader member from one end to the other, the tape drive means including an electric drive motor in an electric circuit of a source of electric potential, and drive control switch means in the electric circuit of the drive motor operable when predetermined indicia appear across the reader member to open said electric circuit and stop the movement of the opaque tape across the reader member, (e) an elongated viewing member, and (f) coupler means registering with each passageway in the reader member for causing a spot of light appearing at a passageway to result in the display of a spot of light at the viewing member moving across the latter from one end to the other.

4. The traveling light display of claim 3 wherein the drive control switch means includes a photocell controlled switch, the photocell being operable when light from a light source passes through a control opening in the opaque tape to open said controlled switch.

* * * * *